US008992003B2

(12) United States Patent
Tamura et al.

(10) Patent No.: US 8,992,003 B2
(45) Date of Patent: Mar. 31, 2015

(54) RECORDING MEDIUM FEEDING DEVICE AND RECORDING APPARATUS

(71) Applicant: Seiko Epson Corporation, Tokyo (JP)

(72) Inventors: Tetsuya Tamura, Matsumoto (JP); Kazuhisa Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 58 days.

(21) Appl. No.: 13/804,915

(22) Filed: Mar. 14, 2013

(65) Prior Publication Data

US 2013/0250022 A1 Sep. 26, 2013

(30) Foreign Application Priority Data

Mar. 26, 2012 (JP) ..... 2012-069212

(51) Int. Cl.
*B41J 11/02* (2006.01)
*B41J 13/10* (2006.01)

(52) U.S. Cl.
CPC ..... *B41J 11/02* (2013.01); *B41J 13/103* (2013.01)
USPC ..... 347/104; 271/9.01; 271/18

(58) Field of Classification Search
CPC ..... A41H 43/02; B41F 1/28; B41J 11/0065; B41J 11/007; B41J 11/0085; B41J 11/02; B41J 11/06; B41J 13/103; B65H 1/04; B65H 1/266; B65H 3/44; B65H 2402/10; G03B 42/045; G03D 13/003; G03G 15/6502
USPC ..... 347/101, 104, 108; 271/9.01, 18; 101/483; 399/367
See application file for complete search history.

(56) References Cited

U.S. PATENT DOCUMENTS

| | | | | |
|---|---|---|---|---|
| 2004/0245703 | A1* | 12/2004 | Yun et al. | 271/110 |
| 2005/0051945 | A1* | 3/2005 | Kang | 271/121 |
| 2006/0236331 | A1* | 10/2006 | Ueda et al. | 720/723 |
| 2011/0074090 | A1* | 3/2011 | Yanagishita | 271/10.01 |
| 2011/0074094 | A1* | 3/2011 | Asada et al. | 271/117 |
| 2011/0156339 | A1 | 6/2011 | Nakano | |
| 2011/0316224 | A1 | 12/2011 | Shinagawa et al. | |
| 2011/0316227 | A1* | 12/2011 | Shinagawa et al. | 271/256 |

FOREIGN PATENT DOCUMENTS

JP 2011-132029 7/2011

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording medium feeding device includes a tray in which accommodates a recording medium, which is attachable to and detachable from a device main body including a feeding unit; a stopper that is able to switch between a regulating state in which the stopper comes into contact with a leading edge of the recording medium which is accommodated in the tray to regulate a movement of the recording medium, and a regulating release state that enables the recording medium to be fed to a feeding path; and a switching unit that is engaged with the tray to switch the stopper from the regulating state to the regulating release state, wherein the switching unit includes engaging portions that engages with the tray, and wherein the engaging portions are disposed, being separated from the stopper at the both sides of the stopper in a width direction of the recording medium.

10 Claims, 8 Drawing Sheets

RECORDING MEDIUM FEEDING DEVICE AND RECORDING APPARATUS

BACKGROUND

1. Technical Field

The present invention relates to a recording medium feeding device and a recording apparatus including the same.

In the invention, the recording apparatus includes an ink jet printer, a line printer, a copy machine, a facsimile, and the like.

2. Related Art

In the related art, in a recording apparatus such as an ink jet printer, there is provided a recording medium feeding device that separates one sheet of recording media from a sheet feeding tray which supports a plurality of stacked recording media, and feeds it to a recording unit which performs a recording process, and the like. In the recording medium feeding device, there is provided a separating inclined portion that is inclined at a predetermined angle with respect to a surface on which the recording media in the sheet feeding tray is placed. The recording medium stacked on the sheet feeding tray comes into contact with a pick-up roller and then is fed out toward the separating inclined portion. At this time, leading edges of the recording media which are fed in a state in which a plurality of sheets is stacked one on top of another, come into contact with the inclined surface of the separating inclined portion and are subjected to the influence of a load (including a reaction force and a frictional force) in the direction opposite to the feeding direction. Thereby, the stacked recording media are separated by the separating inclined portion and finally, only one recording medium which is at the topmost position is fed out to the downstream side of a feeding path.

Incidentally, in the recording medium feeding device, the separating inclined portion is installed at a position opposing the leading edge of the recoding medium accommodated in the sheet feeding tray. Therefore, if the sheet feeding tray is forcefully inserted in a recording medium feeding device main body (hereinafter, referred to as a "device main body"), the recording medium is moved from an interior of the tray in the insertion direction due to an inertial force and thus is likely to ride on the inclined surface of the separating inclined portion. Therefore, there is a possibility that the recording medium feeding device may not separate the stacked recording media one by one and thus the stacked recording media may be fed as they are stacked one on top of another. In addition, even though the sheet feeding tray is slowly attached to the device main body, the recording medium may frequently ride on the inclined surface of the separating inclined portion.

Techniques for solving such a problem have been studied. For example, in JP-A-2011-132029, a stopper mechanism is installed at the position opposing the leading edge of the recording medium in the device main body. The stopper mechanism is configured to enable the displacement between a regulating state where the movement of the recording medium is regulated in the insertion direction of the sheet feeding tray when the sheet feeding tray is inserted to the device main body and a regulating release state where in a predetermined time after the sheet feeding tray is inserted, the regulating state is released, and the recording medium is able to be fed to the feeding path.

Incidentally, in the recording medium feeding device, an engaging portion is disposed in the vicinity of the stopper such that the engaging portion is engaged with the sheet feeding tray to switch the stopper from the regulating state to the regulating release state, and thus the state of the stopper is switched by a displacement operation of the engaging portion. However, in the configuration of the related art, since the engaging portion was disposed in the vicinity of the stopper, it was difficult to reduce the size of the stopper mechanism.

However, on the other hand, if the engaging portion is separated from the stopper, the engaging portion, that is a portion which receives a force from the sheet feeding tray, and the stopper, that is a portion which applies the reaction force with respect to the engaging portion, are separated from each other. Accordingly, due to the influence of a rotating moment, the displacement is made even whilst a force being applied to the engaging portion in a direction deflected with respect to an inherent displacement direction and thereby the engaging portion is unable to smoothly perform the displacement operation, that is, there is a possibility that switching the state of the stopper may not be performed.

SUMMARY

An advantage of some aspects of the invention is to provide a recording medium feeding device and a recording apparatus in which separating an engaging portion from a stopper no longer causes trouble in a switching operation of the stopper.

In addition, a sheet accommodating portion in which sheets are accommodated in a recording apparatus is referred to as various terms such as a "cassette" and a "tray", however, in the present description, the term of the "tray" is used.

According to a first aspect of the invention, there is provided a recording medium feeding device including a feeding unit that feeds a recording medium; a tray that accommodates a recording medium, which is attachable to and detachable from a device main body including the feeding unit; a stopper that is able to switch between a regulating state in which the stopper comes into contact with a leading edge of the recording medium which is accommodated in the tray to regulate a movement of the recording medium, and a regulating release state in which the regulating state is released to enable the recording medium to be fed to a feeding path; and a switching unit that, is engaged with the tray to switch the stopper from the regulating state to the regulating release state when the tray is inserted into the device main body, wherein the switching unit includes engaging portions that are engaged with the tray, and wherein the engaging portions are disposed, being separated from the stopper, at both sides of the stopper in a width direction of the recording medium.

In this aspect, since the engaging portions are disposed at positions separated from the stopper, it is possible to reduce the size of the stopper and the switching unit of the stopper. In addition, when the tray and the engaging portions are engaged with each other, a force which acts on the engaging portions is applied to the stopper and the switching unit via the engaging portions which are disposed at both sides of the stopper. Therefore, it is possible to reduce the force applying to the engaging portions in the direction deflected with respect to a displacement direction thereof.

The switching unit may include a first biasing unit that biases the stopper in a direction of the stopper from the regulating state to the regulating release state in one side of the engaging portions between the engaging portions which are disposed at both sides of the stopper, a second biasing unit that biases the stopper in a switching direction of the stopper from the regulating state to the regulating release state in the other side of the engaging portions of the engaging portions which are disposed at both sides of the stopper, a third biasing unit that biases the stopper in a direction that switches the stopper from the regulating release state to the regulating state in one side of the engaging portions, and a fourth biasing unit that biases the stopper in a switching direction of the stopper from the regulating release state to the regulating state in the other side of the engaging portions.

In this case, since the switching unit is provided with the biasing units that bias the stopper in a switching direction from the regulating state to the regulating release state, and in the switching direction from the regulating release state to the regulating state, in the individual engaging portion, it is possible to reliably switch the stopper to an individual state. In addition, in the invention, the term "biasing the stopper" may also include either directly biasing the stopper or indirectly biasing the stopper via the other member.

An individual biasing force of the first biasing unit and the second biasing unit may be set to be decreased as a distance becomes longer, depending on the distance between the position at which the individual biasing unit biases the engaging portion and the stopper.

In this case, since the individual biasing force of the first biasing unit and the second biasing unit is set such that rotating moments which act on the one side of the engaging portions and the other side of the engaging portions are substantially similar to each other, it is possible to reduce the force applying to the engaging portions even in the direction deflected with respect to the displacement direction thereof.

An individual biasing force of the third biasing unit and the fourth biasing unit may be set to be decreased as the distance becomes longer, depending on the distance between the position at which the individual biasing unit biases the engaging portion and the stopper.

In this case, since the individual biasing force of the third biasing unit and the fourth biasing unit is set such that as the rotating moments which act on the one side of the engaging portions and the other side of the engaging portions are substantially similar to each other, it is possible to reduce a possibility that the engaging portion may be gouged.

According to a second aspect of the invention, there is provided a recording medium feeding device including a feeding unit that feeds a recording medium, a lower side tray that accommodates a recording medium, which is attachable to and detachable from a device main body including the feeding unit, an upper side tray that accommodates a recording medium, which is attachable to and detachable from the device main body and is located above a mounting position of the lower side tray when being mounted in the device main body, a stopper that is able to switch between a regulating state which comes into contact with a leading edge of the recording medium which is accommodated in the lower side tray to regulate a movement of the recording medium, and a regulating release state in which the regulating state is released to enable the recording medium to be fed to a sheet feeding path, and a switching unit that is engaged with the lower side tray to switch the stopper from the regulating state to the regulating release state when the lower side tray is inserted into the device main body, wherein the switching unit includes engaging portions that are engaged with the lower side tray, and wherein the engaging portions are disposed, being separated from the stopper, at both sides of the stopper in a width direction of the recording medium.

In this aspect, since the engaging portions are disposed at the positions separated from the stopper, it is possible to reduce the size of the stopper and the switching unit of the stopper. In addition, when the lower side tray and the engaging portion are engaged with each other, the force which acts on the engaging portions acts on the stopper and the switching unit via the engaging portions disposed at both sides of the stopper. Therefore, it is possible to reduce the force applying to the engaging portions in the direction deflected with respect to the displacement direction thereof.

The stopper may be formed at a height where the stopper is able to engage with the leading edge of the recording medium which is accommodated in the lower side tray, and at a height where the stopper does not engage with the recording medium which is accommodated in the upper side tray.

In this case, the size of the stopper may be reduced in the height direction of the recording apparatus and the size of the recording apparatus may be reduced in the height direction.

The recording medium feeding device may further include a braking mechanism that applies a braking force to the stopper when switching from the regulating state of the stopper to the regulating release state.

In this case, the switching operation of the stopper may be smoothly performed and thereby after the operation of the leading edge of the recording medium which is accommodated in the tray is reliably regulated, the stopper may be switched to the regulating release state.

The switching unit may include a first slider that is engaged with the stopper and is displaceable in an advancing and retreating direction with respect to the leading edge of the recording medium, a second slider that is displaceable together with the engaging portion in the advancing and retreating direction, and a connecting member that connects the first slider and the second slider together.

In this case, the switching unit is divided into the first slider, the second slider and the connecting member and thereby components may be easily molded so that a low cost is realized.

The connecting member may be molded by sheet metal working.

In this case, it is possible to increase the rigidity of the connecting member and also it is possible to decrease bending of the connecting member even though the distance is long between the position where the engaging unit is biased and the stopper.

According to a third aspect of the invention, there is provided a recording apparatus including a recording unit that performs recording on the recording medium; and any one of the recording medium feeding devices described above.

According to the third aspect, in the recording apparatus, it is possible to obtain the same operation effects as those in the first and second aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
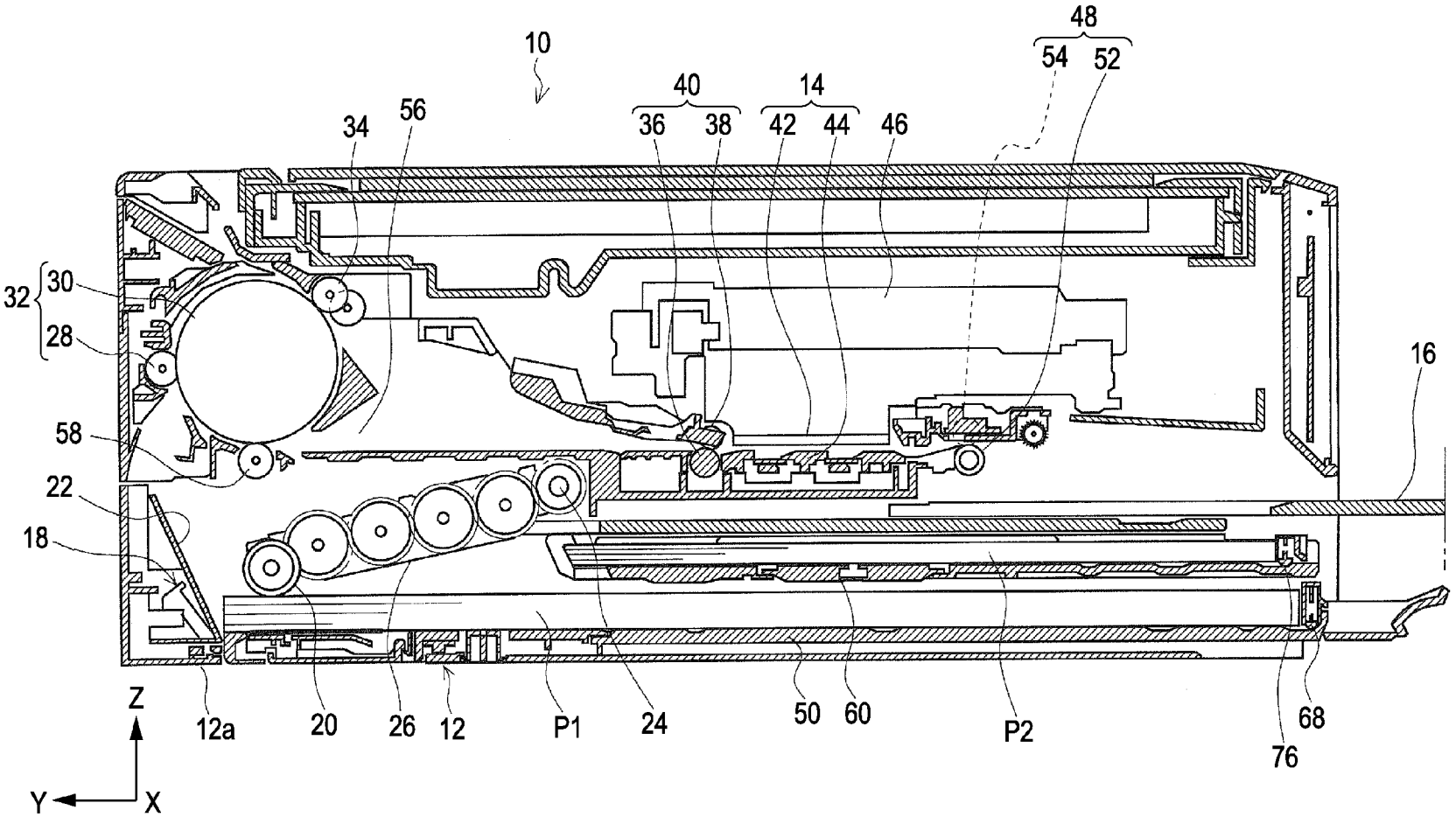
FIG. 1 is a side cross-sectional view of a printer according to the present invention when an upper side tray is located in a retreated position.

Hereinafter, embodiments of the present invention will be described with reference to the accompanying drawings. In addition, in each embodiment, the same reference numerals will be given to the same configuration and description will be given only in the first embodiment, and in subsequent embodiments the description of the configuration will be omitted.

Figure 2:
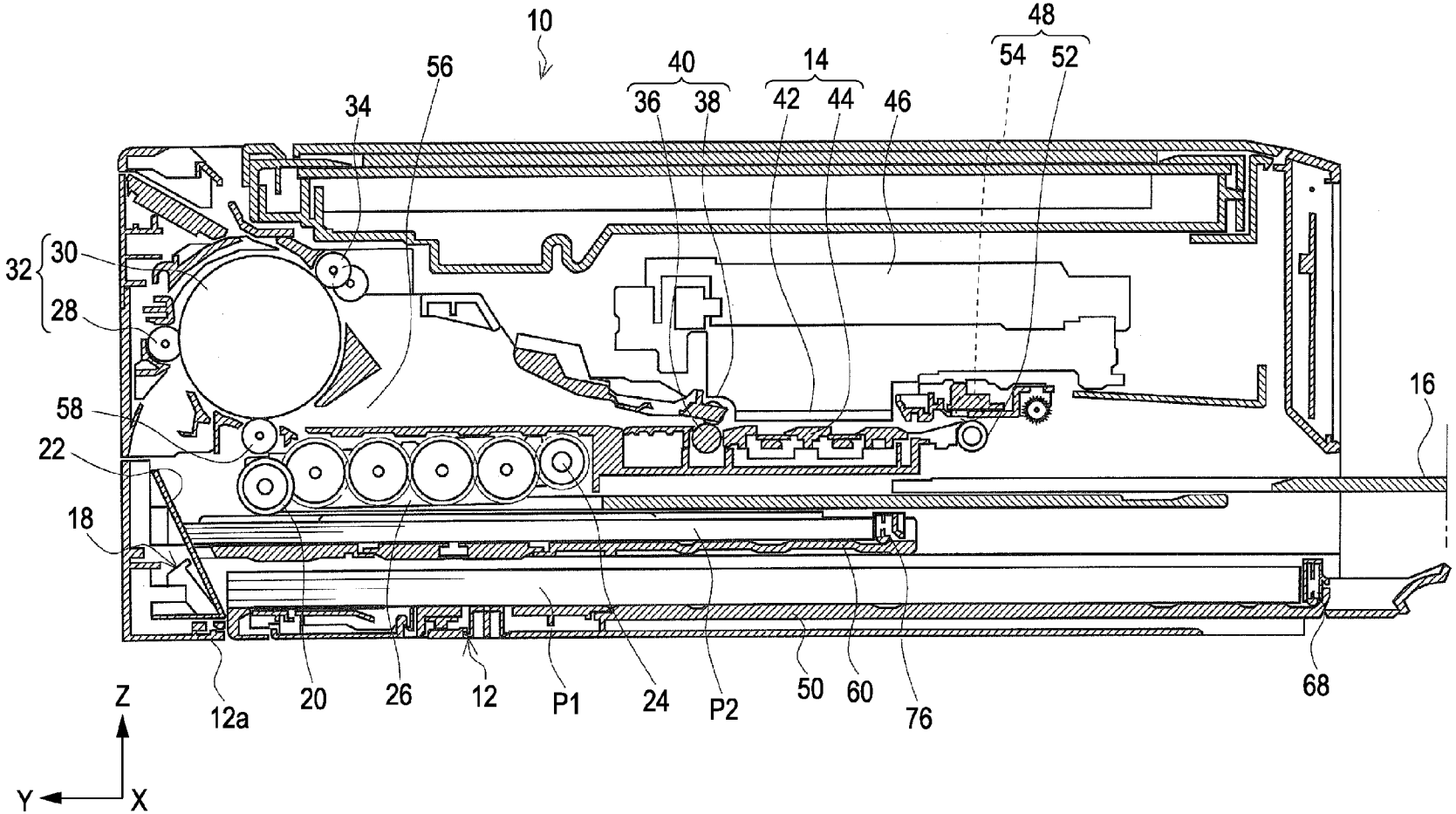
FIG. 2 is a side cross-sectional view of the printer according to the present invention when the upper side tray is located in an abutting position.
Figure 3:
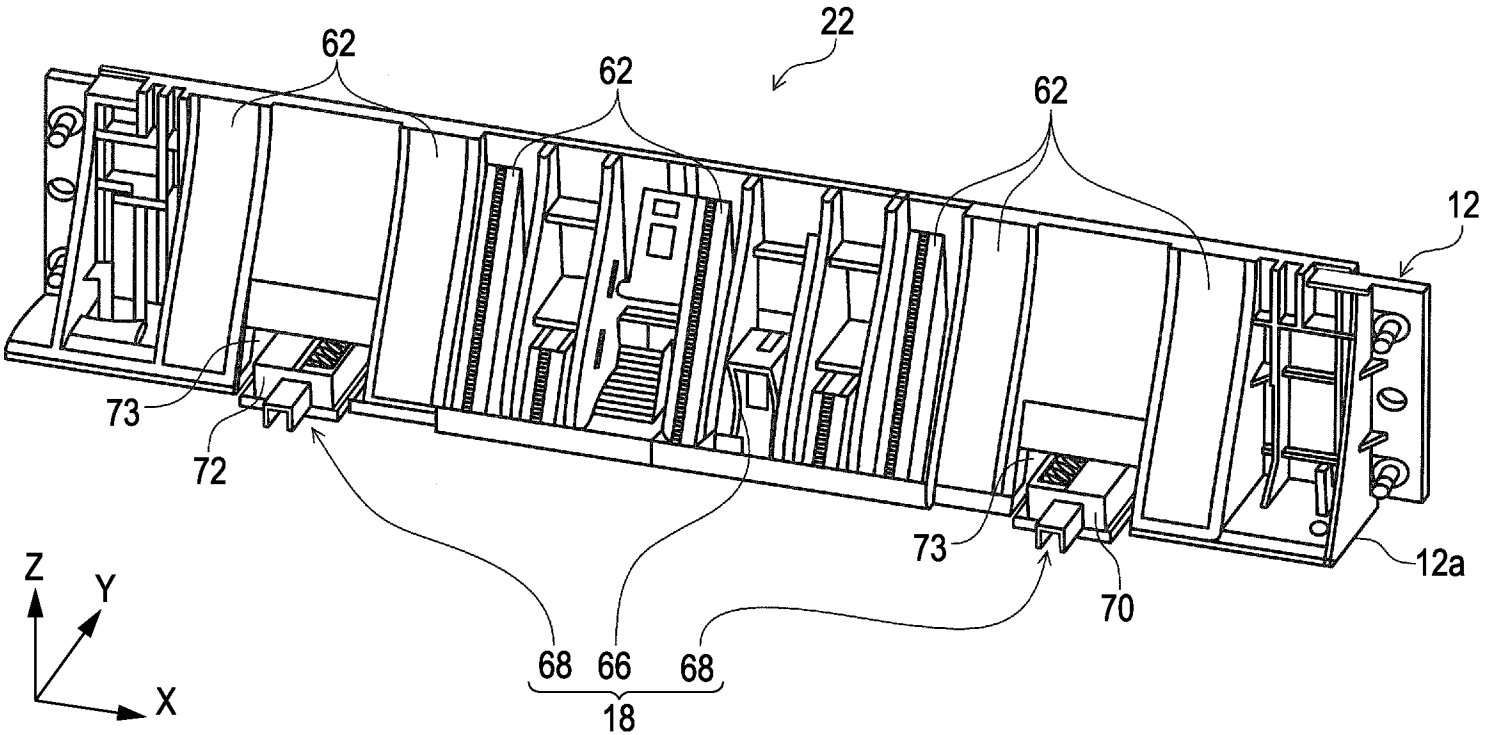
FIG. 3 is a perspective view illustrating a portion opposing a leading edge of a sheet which is accommodated in a lower side tray, in a sheet feeding device main body according to a first embodiment.
Figure 4:
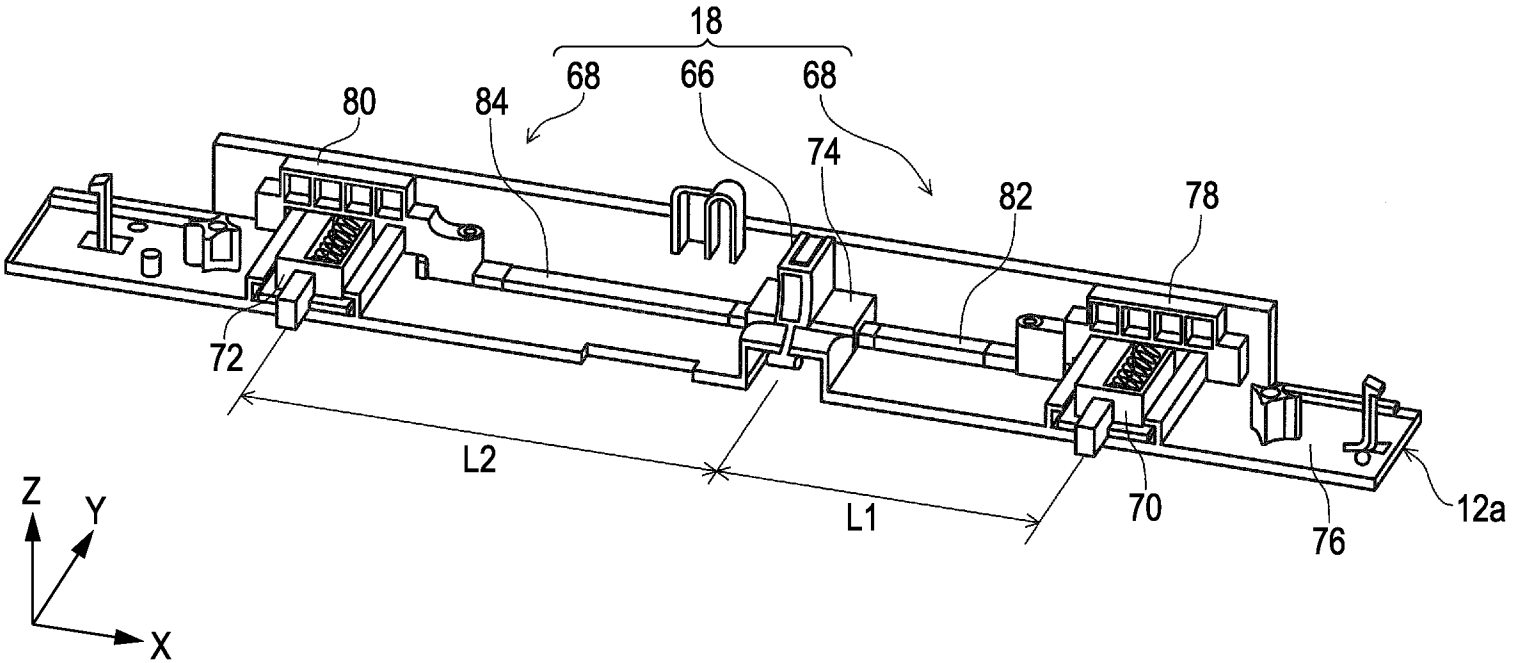
FIG. 4 is a perspective view illustrating a stopper mechanism in the first embodiment.
Figure 5:
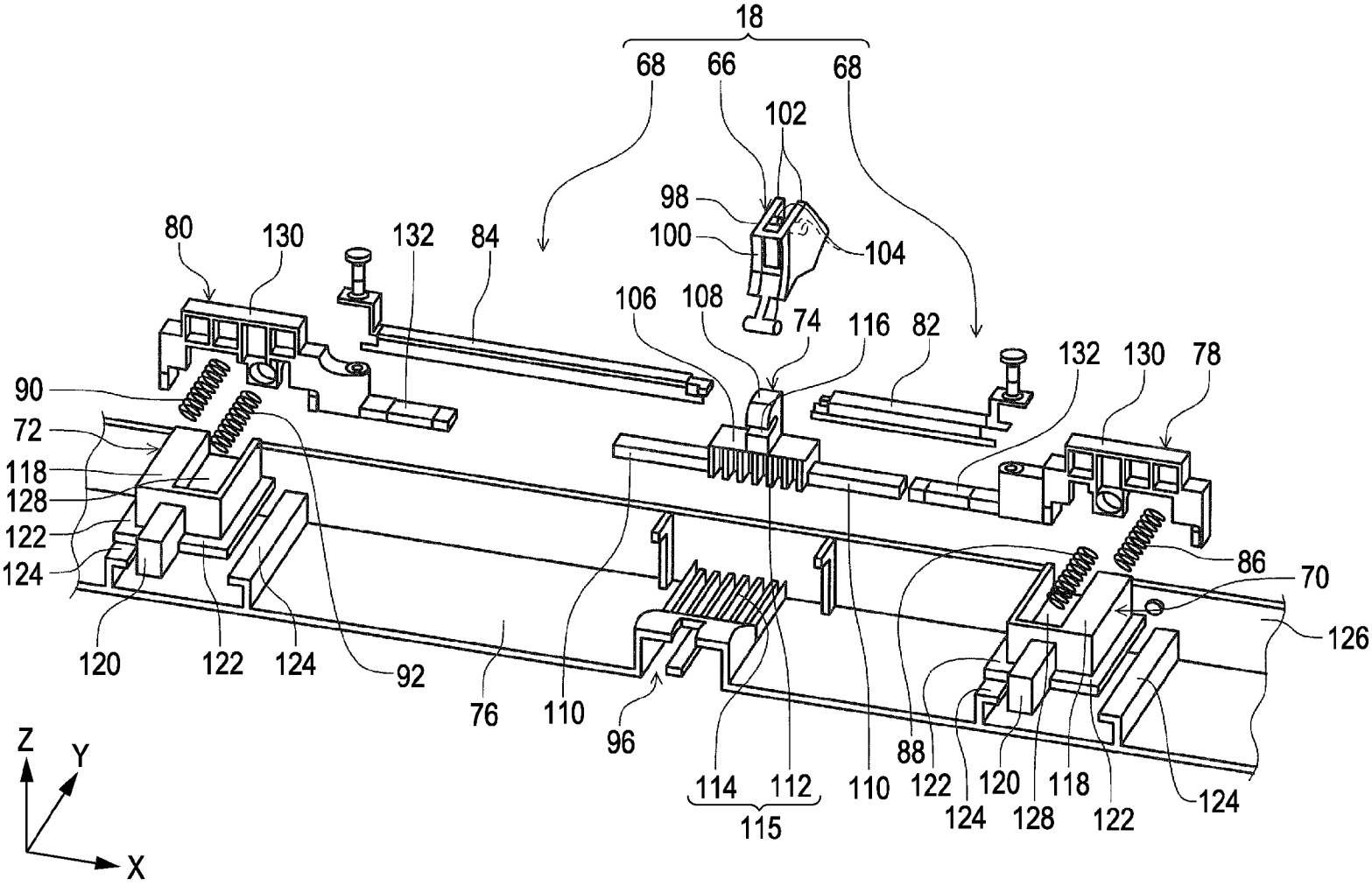
FIG. 5 is an exploded perspective view illustrating a configuration of the stopper mechanism in the first embodiment.

FIG. 1 is a side cross-sectional view of an ink jet printer (hereinafter, referred to as a "printer") 10 according to one embodiment of the "recording apparatus" when an upper side tray is located in a retreated position. FIG. 2 is a side cross-sectional view of the printer 10 when the upper side tray is located in an abutting position. FIG. 3 is a perspective view illustrating a portion opposing a leading edge of a sheet which is accommodated in a lower side tray, in a sheet feeding device main body according to a first embodiment. FIG. 4 is a perspective view illustrating a stopper mechanism in the first embodiment. FIG. 5 is an exploded perspective view illustrating a configuration of the stopper mechanism in the first embodiment.

Figure 6:
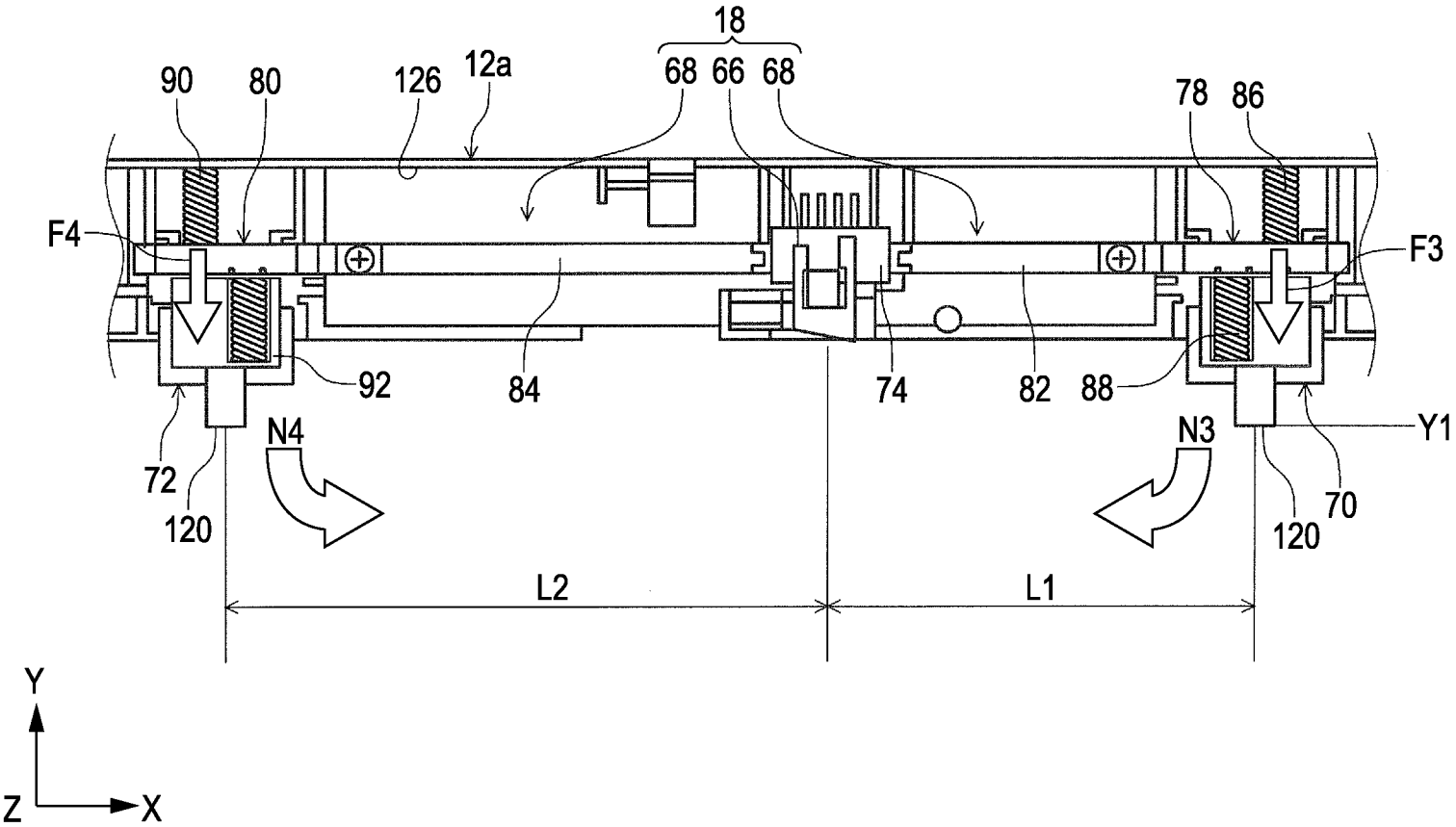
FIG. 6 is a plan view illustrating a disengaged state of the stopper mechanism in the first embodiment.
Figure 7:
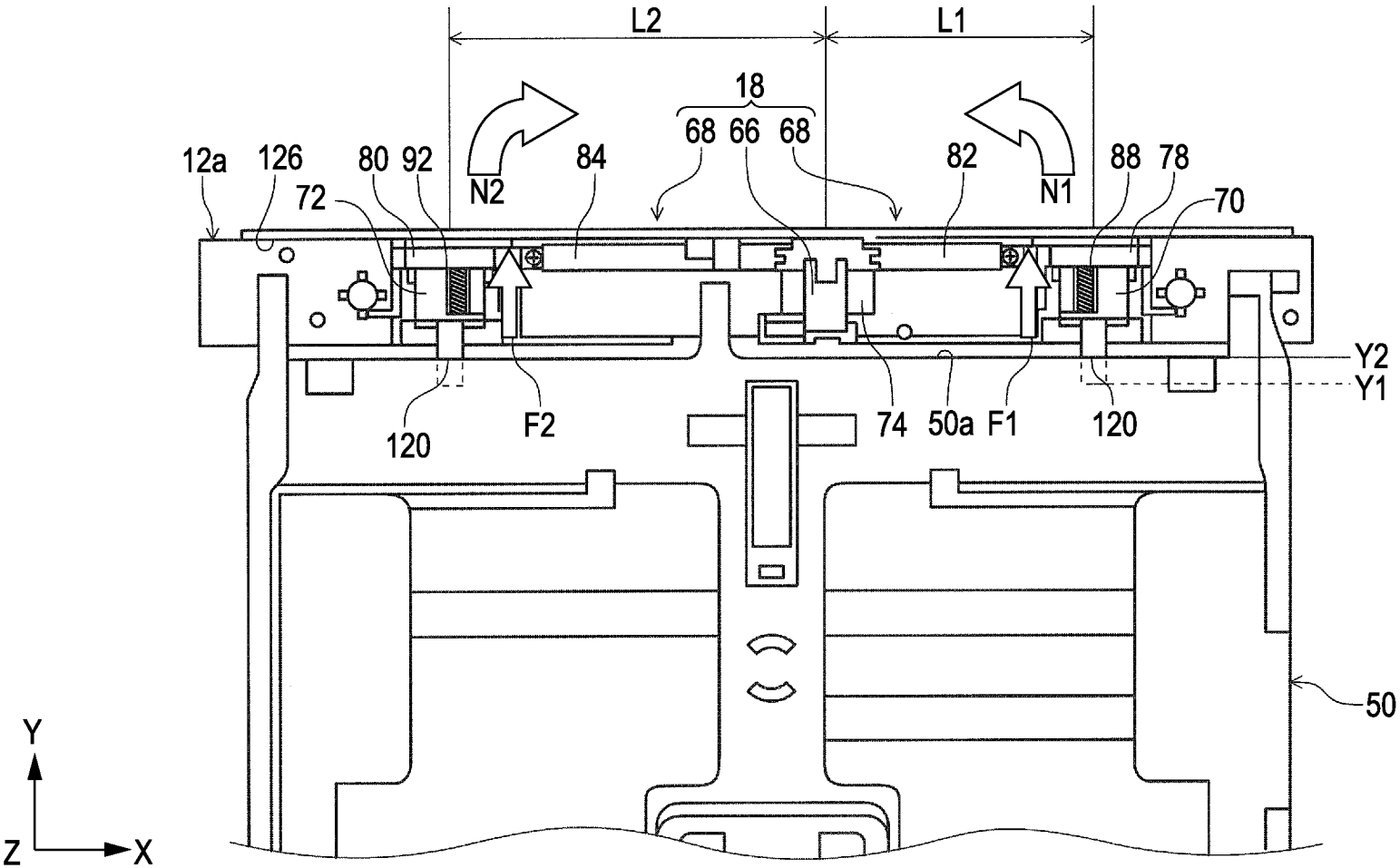
FIG. 7 is a plan view illustrating an engaged state between the stopper mechanism and the lower side tray in the first embodiment.
Figure 8A:
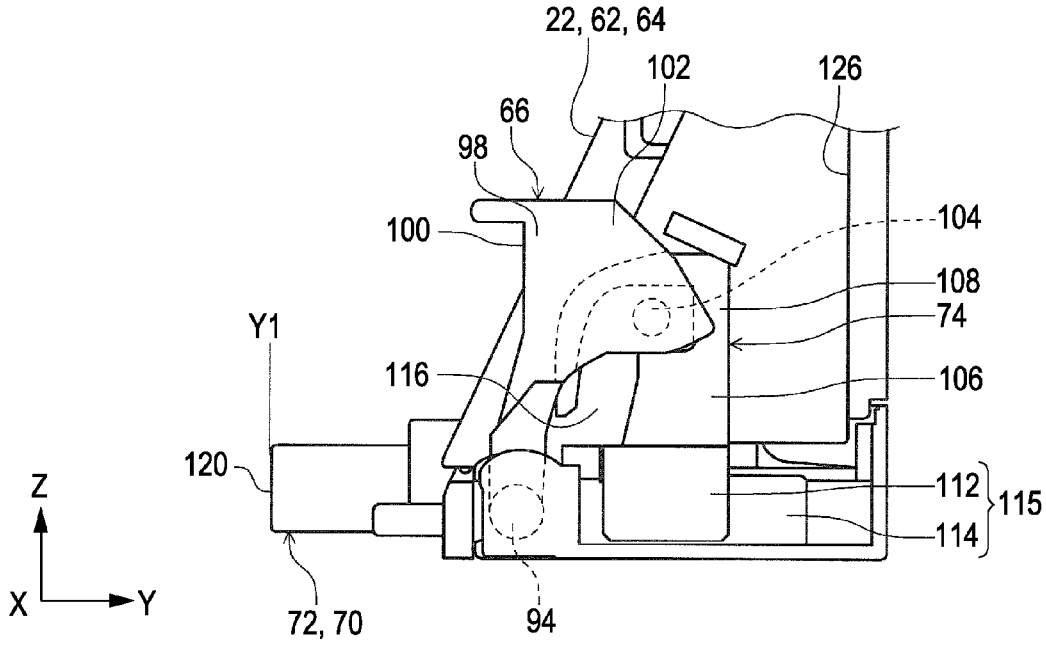
FIG. 8A is a side view illustrating a regulating state of the stopper in the first embodiment.
Figure 8B:
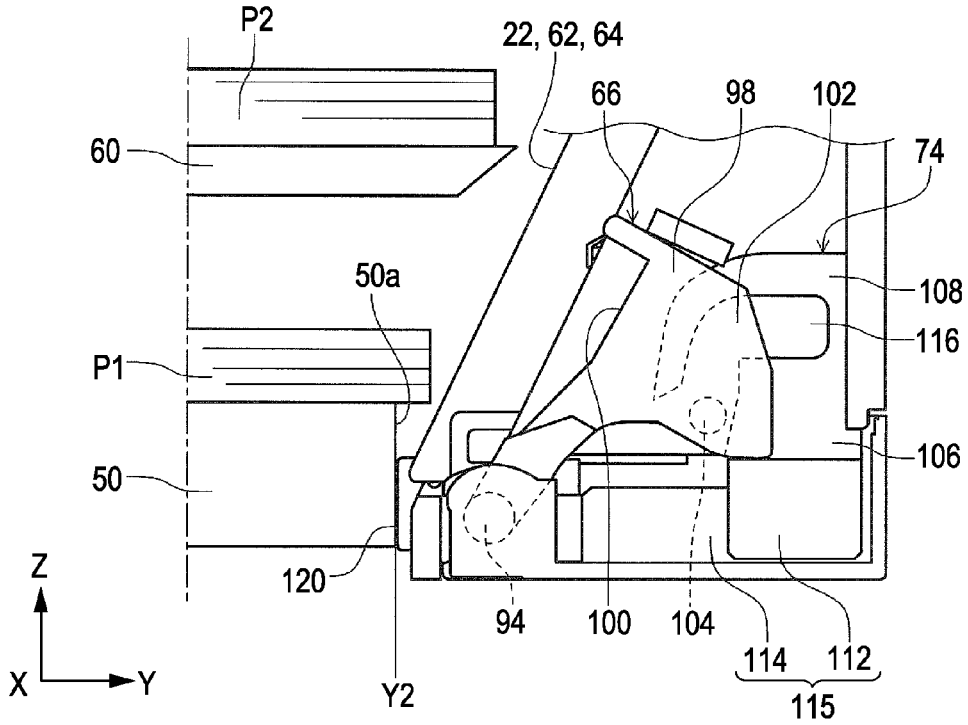
FIG. 8B is a side view illustrating a regulating release state of the stopper in the first embodiment.

In addition, FIG. 6 is a plan view illustrating a disengaged state of the stopper mechanism in the first embodiment. FIG. 7 is a plan view illustrating an engaged state between the stopper mechanism and the lower side tray in the first embodiment. FIG. 8A is a side view illustrating a regulating state of the stopper in the first embodiment. FIG. 8B is a side view illustrating a regulating release state of the stopper in the first embodiment.

In addition, in FIGS. 1 and 2, almost all of rollers are illustrated on the same plane, so as to illustrate the rollers which are disposed on a sheet transportation path of a printer 10. However, positions in the depth direction (frontward and backward directions from the sheet surface of FIGS. 1 and 2) are not necessarily matched (in some cases, matched). In addition, in an X-Y-Z axis direction coordinate system illustrated in each drawing, an X axis direction indicates a direction perpendicular to a sheet transporting (feeding) direction, a Y axis direction indicates the sheet transporting direction (a sheet feeding direction), and a Z axis direction indicates a height direction of the device, that is, the direction of the gravity.

Hereinafter, with reference to FIGS. 1 and 2, the overall configuration of the printer 10 will be described. The printer 10 includes a recording medium feeding device (hereinafter, referred to as a "feeding device") 12, and has a configuration where a sheet of paper (mainly a single sheet: hereinafter, referred to as a "sheet P") as an example of the "recording medium" is fed one by one from the recording medium feeding device, recording (ink jet recording) in a recording unit 14 is performed, and then the sheet P is discharged toward a sheet discharge stacker 16 which is installed at the front side (FIGS. 1 and 2, −Y axis direction) of the device.

Hereinafter, more detailed descriptions will be made with regard to configuration elements on a sheet transporting path. The feeding device 12 includes a lower side tray 50, an upper side tray 60 which is located on the upper side thereof, a stopper mechanism 18, a pick-up roller 20 and a first separating unit 22. The lower side tray 50 and the upper side tray 60 as a sheet accommodating portion capable of setting a plurality of sheets P in a stacked state are respectively configured to be attachable to or detachable from the front side of feeding device 12. In addition, the upper side tray 60 is driven in a sheet transporting direction (FIGS. 1 and 2, Y axis direction) by a motor (not illustrated) and is configured to be movable between an abutting position, that is, a position capable of feeding the sheet (refer to FIG. 2) and a retreated position (refer to FIG. 1) displaced from the abutting position by a predetermined displacement amount to the opposite side to the sheet transporting direction.

In addition, in FIGS. 1 and 2, the sheet accommodated in the lower side tray 50 is represented by the reference numeral P1 and the sheet accommodated in the upper side tray 60 is represented by the reference numeral P2, respectively (hereinafter, referred to as the "sheet P" in a case where there is no need to specifically distinguish them).

A stopper mechanism 18 is installed at a position opposing the leading edge of the sheet P1 which is accommodated in the lower side tray 50 in the feeding device 12. The stopper mechanism 18 is configured to be switchable between a regulating state (refer to FIG. 8A) and a regulating release state (refer to FIG. 8B) by being engaged with the lower side tray 50. When the stopper mechanism 18 is in the regulating state, the stopper mechanism 18 comes into contact with the leading edge of the sheet P1 to regulate the movement of the sheet P1, and when the stopper mechanism 18 is in the regulating release state, the stopper mechanism 18 enables the sheet P1 to move to a feeding path. The stopper mechanism 18 holds the regulating state when the lower side tray 50 is in a detached state.

A pick-up roller 20 is rotationally driven by a motor (not illustrated) and is installed on an oscillating member 26 which oscillates about the center of an oscillating axis 24. The pick-up roller 20 rotates while coming into contact with the topmost sheet P1 which is accommodated in the lower side tray 50 when the upper side tray 60 is slid in the furthest retreated direction (FIGS. 1 and 2, −Y axis direction), that is, when the upper side tray 60 is located at the retreated position (refer to FIG. 1) and also when the stopper mechanism 18 is in the regulating release state, and thereby feeds the topmost sheet P1 from the lower side tray 50 to the feeding path.

In addition, the pick-up roller 20 rotates while coming into contact with the topmost sheet P2 which is accommodated in the upper side tray 60, in the abutting position where the upper side tray 60 is slid in the deepest direction (sheet feeding direction: FIGS. 1 and 2, +Y axis direction) of the device, that is, in a position where the sheet feeding is possible (refer to FIG. 2), and thereby feeds the topmost sheet P2 from the upper side tray 60 to the feeding path.

In the feeding device 12, a first separating unit 22 is installed at a position opposing the leading edges of the sheet P1 which is set in the lower side tray 50 or at a position opposing the leading edges of the sheet P2 which is set in the upper side tray 60. The first separating unit 22 comes into contact with the leading edge of sheet P which is fed out from the lower side tray 50 or the upper side tray 60 by the rotation of the pick-up roller 20, and in a state in which the sheet P is in contact with the first separating unit 22, the sheet P is transported to a downstream side of the feeding path. Thereby, the topmost sheet P and the subsequent top sheet P are separated.

At the downstream side of the feeding path of the first separating unit 22, a second separating unit 32 is installed, which is configured to include a separating roller 28 and a driving roller 30 driven by a motor (not illustrated) and separates the sheets P. In addition, at the downstream side of the feeding path of the second separating unit 32, a driven roller 34 is installed, which is driven to rotate by pinching the sheet P with the driving roller 30. In addition, at the downstream side of the feeding path of the driven roller 34, a transportation unit 40 is installed, which is provided with a transportation driving roller 36 which is driven by a motor (not illustrated) and a transportation driven roller 38 which is driven to rotate while being in pressed contact with the transportation driving roller. The sheet P is fed to the further downstream side by the transportation unit 40.

At the downstream side of the transportation unit 40, a recording unit 14 is installed. The recording unit 14 is provided with a recording head 42 and a lower guide member 44 which opposes the recording head. The recording head 42 opposes the sheet P, being installed at the bottom portion of a carriage 46. The carriage 46 is driven to reciprocate in a main scanning direction (frontward and backward directions from the sheet surface of FIG. 1, that is, X axis direction) by a driving motor (not illustrated).

The lower guide member 44 supports the sheet P and defines a distance between the sheet P and the recording head 42. Then, at the downstream side of the lower guide member 44, a discharge unit 48 is installed, which discharges the sheet P on which the recording has been performed. The discharge unit 48 is provided with a discharge driving roller 52 which is driven by a motor (not illustrated) and a discharge driven roller 54 that comes into contact with the discharge driving roller and is driven to rotate. The sheet P on which the recording is performed by the recording unit 14 is pinched by the discharge unit 48 and is discharged to the sheet discharge stacker 16 which is installed at the front side of the device. In addition, the sheet discharge stacker 16 is configured to be extractable to the front side of the device.

In addition, in a case where the recording is performed on both surfaces of the sheet P in the printer 10, the recording is performed on the first surface of the sheet P by the recording unit 14, and thereafter, the sheet P is returned to an upstream side of the transportation unit 40 so that a trailing edge of the sheet when the recording has been performed on the first surface becomes the leading edge by a reverse operation of the transportation unit 40 and the discharge unit 48. Then, the sheet P is further fed to an inversing path 56 by the reverse operation of the transportation unit 40. The sheet P which is fed to the inversing path 56 is pinched by the driving roller 30 and an inverse roller 58 and is returned to the feeding path again.

The sheet P which is returned to the feeding path is fed again to the transportation unit 40 at the downstream side of the feeding path by the driving roller 30 through the separating roller 28 and the driven roller 34. At this time, the first surface and the second surface of the sheet P are curved to be reversed to the second surface and then oppose the recording head 42. The sheet P is fed to the recording unit 14 by the transportation unit 40. The sheet P on which the recording of the second surface has been performed by the recording unit 14 is pinched by the discharge unit 48 and then is discharged to the sheet discharge stacker 16 that is installed on the front side of the device.

Referring to FIG. 3, in the sheet feeding device 12, a portion 12*a* (hereinafter, referred to as an "opposing portion") which opposes the leading edge of the sheet P1 which is accommodated in the lower side tray 50 and the leading edge of the sheet P2 which is accommodated in the upper side tray 60 is illustrated. The opposing portion 12*a* is configured by the stopper mechanism 18 that regulates the movement of the sheet P1 and the first separating unit 22 that separates the sheets P.

The first separating unit 22 is provided with a plurality of first separating inclined surfaces 62 and a plurality of second separating inclined surfaces 64 that extend along with the sheet feeding path. The second separating inclined surfaces 64 have a height different from the first separating inclined surfaces 62 in the height direction of the recording apparatus. The first separating inclined surfaces 62 are disposed with an appropriate space in the X axis direction in the opposing portion 12*a*, and oppose the sheet P1 which is accommodated in the lower side tray 50 and the sheet P2 which is accommodated in the upper side tray 60.

The second separating inclined surfaces 64 are set so that their height is lower than the lower side of the upper side tray 60. That is, the second separating inclined surfaces 64 do not oppose the leading edge of the sheet P2 which is accommodated in the upper side tray 60. For this reason, when the sheet P1 which is accommodated in the lower side tray 50 is fed, the first separating inclined surfaces 62 and the second separating inclined surfaces 64 come into contact with the leading edge of the sheet P1 and thus separate the sheets P1.

When the sheet P2 which is accommodated in the upper side tray 60 is fed, the first separating inclined surfaces 62 come into contact with the leading edges of the sheets P2 and separates the sheets P2. Accordingly, the first separating unit 22 is able to change the separating conditions in conjunction with the sheets P1 which are accommodated in the lower side tray 50 or the sheet P2 which is accommodated in the upper side tray 60 by changing the number of the separating inclined surfaces which come into contact with the leading edge of the sheet and thereby it is possible to allow optimum separating conditions in conjunction with the sheets P1 and P2 respectively.

First Embodiment

The stopper mechanism 18 is provided with a stopper 66 that is disposed in the vicinity of the center of the X axis direction in the opposing portion 12*a* and a switching unit 68 that switches the stopper 66 from the regulating state to the regulating release state. In a state in which the first separating unit 22 is attached to the opposing portion 12*a*, the switching unit 68 has the upward and forward sides (−Y axis direction) covered by the first separating unit 22.

The switching unit 68 is provided with engaging portions 70 and 72 that are disposed with a distance in the X axis direction from the stopper 66 at both sides of the stopper 66. The engaging portions 70 and 72 are disposed in openings 73 and 73 that are installed at positions pinched by the first separating inclined surfaces 62 of the first separating unit 22. In addition, the engaging portions 70 and 72 are configured to be displaceable in the Y axis direction with respect to the opposing portion 12*a* and when being in a disengaging state with the lower side tray 50, is protruded further than the first separating unit 22 in the −Y axis direction. Hereinafter, the stopper mechanism 18 will be described in more detail with reference to FIGS. 4 and 5.

The switching unit 68 is provided with a cam slider 74 that is engaged with the stopper 66 as a "first slider" and is displaceable in the Y axis direction, the first engaging portion 70 that is disposed with a distance in the X axis direction from the stopper 66, the second engaging portion 72 that is disposed with a distance in the −X axis direction from the stopper 66, a first engaging slider 78 that is displaceable in the Y axis direction together with the first engaging portion 70 as a "second slider", and a second engaging slider 80 that is displaceable in the Y axis direction together with the second engaging portion 72 as the "second slider".

In addition, the switching unit 68 is provided with a first connecting member 82 that connects a cam slider 74 and the first engaging slider 78 as a "connecting member", a second connecting member 84 that connects a cam slider 74 and the second engaging slider 80 as a "connecting member", a coil spring 88 as a "first biasing unit" and a coil spring 86 as a "third biasing unit" that are disposed at the first engaging portion 70 side, and a coil spring 92 as a "second biasing unit" and a coil spring 90 as a "fourth biasing unit" that are disposed at the second engaging portion 72 side.

At the lower end of the stopper 66, a stopper rotating axis 94 that extends in the X axis direction is installed. The stopper rotating axis 94 is fitted with a hook-shaped bottom engaging portion 96 that is installed at the bottom surface 76 of the opposing portion 12*a*. In the upper side of the stopper rotating axis 94, a regulating portion 98 for regulating the movement of the sheet P1 is installed. In the regulating portion 98, a regulating surface 100 which comes into contact with the leading edges of the sheets P1 is formed and then a pair of side walls 102 that extends in the Y axis direction from both sides of the regulating surface 100 in the X axis direction is installed. On a pair of the side walls 102, engaging pins 104 that are protruded in the X axis direction from the side walls and oppose each other are installed.

The cam slider 74 is provided with a main body 106, a stopper engaging portion 108 that is protruded in the Z axis direction from the main body 106, and a pair of connecting portions 110 that is protruded to both sides in the X axis direction from the main body 106 to be extended in the X axis direction. In the main body 106, a first sliding portion 112 is installed. The first sliding portion 112 is formed with concave portions and convex portions such that when the Y axis direction is set to a sliding direction, the shape of the cross section intersecting the sliding direction, that is, the cross section in the X axis direction comes to have a concave and convex shape (so called, comb-teeth shape) that concave and convex portions are repeatedly formed in the X axis direction. In addition the concave and convex portions are extended along the Y axis direction.

In addition, a second sliding portion 114 that is fitted to the first sliding portion 112 is installed at the bottom 76 of the opposing portion 12*a*. In the second sliding portion 114, the cross section in the X axis direction comes to have a concave and convex shape (so called, a comb-teeth shape) that concave and convex portions are repeatedly formed in the X axis direction. In addition, the concave and convex portions of the second sliding portion 114 extend along the Y axis direction to be formed longer than the concave and convex portions of the first sliding portion 112 in the Y axis direction.

The first sliding portion 112 and the second sliding portion 114 have their mutual concave and convex portions slidably fitted to each other through a viscous material (such as grease). That is, the cam slider 74 is slidably configured in the Y axis direction with respect to the bottom surface 76 of the opposing portion 12*a*. In addition, the first sliding portion 112 and the second sliding portion 114 configure a braking mechanism 115 that applies a braking force to the cam slider 74 in the Y axis direction.

In the stopper engaging portion 108, slit-shaped engaging space 116 with a predetermined width (refer to FIGS. 8A and 8B) which penetrates in the X axis direction and has an opening end in the −Y axis direction side is provided so as to be diagonally inclined downwardly in the −Y axis direction. The engaging pins 104 of the stopper 66 are engaged with the engaging space 116. The connecting portions 110 are connected to the opposing first engaging slider 78 via the first connecting member 82 or to the second engaging slider 80 via the second connecting member 84.

The first engaging portion 70 is provided with a main body 118 and an engaging protrusion portion 120 that is protruded from the main body 118 in the −Y axis direction. In addition, the first engaging portion 70 has the end portions 122 of both sides in the X axis direction of the main body 118 engaged with a pair of the sliding paths 124 installed on the bottom surface 76 of the opposing portion 12*a* and is configured to be slidable in the Y axis direction while the engagement state is held. One end of the coil spring 86 that is the third biasing unit is supported by or fixed to the rear surface of the main body 118. The other end of the coil spring 86 is fixed to or supported by the rear surface 126 of the opposing portion 12*a*. The coil spring 86 biases the first engaging portion 70 in the −Y axis direction.

In addition, a concave portion 128 is installed in the main body 118. A coil spring 88 is stored in the concave portion 128 and one end of the coil spring 88 is fixed to or supported by the main body 118. The other end of the coil spring 88 is fixed to or supported by the first engaging slider 78. That is, the first engaging portion 70 and the first engaging slider 78 are connected to each other by the coil spring 88 that is the first biasing unit. In addition, the coil spring 86 and the coil spring 88 are disposed in parallel to be expandable and contractible along the Y axis direction.

The first engaging slider 78 is configured by a main body 130 and a connecting portion 132. The coil spring 88 that is supported by or fixed to the main body 118 of the first engaging portion 70 is connected to the main body 130. In addition, the lower portion of the main body 130 is formed in conjunction with an outer shape of the main body 118 of the first engaging portion 70 with a cross-sectional shape in the X axis direction so that the main body 118 of the first engaging portion 70 is slidable with respect to the main body 130. The connecting portion 132 extends toward the cam slider 74 from the main body 130 in the X axis direction. The connecting portion 132 is connected to the connecting portion 110 of the cam slider 74 via the first connecting member 82.

The first connecting member 82 is formed from a metal material by sheet metal working (such as press working) and extends along the X axis direction. The first connecting member 82 connects the connecting portion 110 of the cam slider 74 and the connecting portion 132 of the first engaging slider 78, and covers the upper surface and the side surface of the connecting portions 110 and 132 along the X axis direction so that the connecting portions 110 and 132 are reinforced. Thereby, it is possible to decrease bending in the connecting portions 110 and 132 when the cam slider 74 is displaced. Further, the first connecting member 82 may be formed by the sheet metal working (such as the press working) to achieve the reduced cost.

Configurations of the second engaging portion 72, the second engaging slider 80, the second connecting member 84 and the coil spring 90 that is the fourth biasing unit, and the coil spring 92 that is the second biasing unit are the same as those of the first engaging portion 70, the first engaging slider 78, the first connecting member 82, and the coil springs 86 and 88. Therefore the description thereof will be omitted.

In addition, the coil springs 88 and 92 are configured to act on the stopper 66 when the stopper 66 is displaced from the regulating state to regulating release state. Further, the coil springs 86 and 90 are configured to act on the stopper 66 when the stopper 66 is displaced from the regulating release state to the regulating state. Hereinafter, the displacement of the stopper 66 from the regulating state to the regulating release state or from the regulating release state to the regulating state will be described in detail together with the operations of the coil springs 86, 88, 90 and 92.

Referring to FIG. 6, the first engaging portion 70 is disposed with a distance L1 from the stopper 66. On the other hand, the second engaging portion 72 is disposed with a distance L2 from the stopper 66. The distance L2 is set to be longer than the distance L1. Therefore, if a biasing force (spring force F4) of the coil spring 90 that is the fourth biasing unit which biases the second engaging portion 72 is set to be the same size force as the biasing force (spring force F3) of the coil spring 86 that is the third biasing unit which biases the first engaging portion 70, or is set to be a stronger force than the spring force F3, the rotation moment N4 which acts on the second engaging portion 72 is greater than the rotation moment N3 which acts on the first engaging portion 70. Thereby, when the stopper mechanism 18 is viewed from the direction Z toward the direction −Z, the stopper mechanism 18 is displaced clockwise around the axis of the cam slider 74 and a force is applied to the first sliding portion 112 and the second sliding portion 114 in a direction deflected with respect to the sliding direction.

For this reason, in the present embodiment, the spring force F3 of the coil spring 86 that is the third biasing unit and the spring force F4 of the coil spring 90 that is the fourth biasing unit which biases the second engaging portion 72 are set to be decreased in proportion to the distance from the stopper 66 (as the distances become longer), in comparing the distance L1 with the distance L2. More specifically, the rotation moment N3 (=F3×L1) which acts on the first engaging portion 70 and the rotation moment N4 (=F4×L2) which acts on the second engaging portion 72 are set to be substantially the same. Such a relationship allows that the rotation moments N3 and N4 which act on the first engaging portion 70 and the second engaging portion 72 are balanced with each other, and thereby the forces are unlikely to be applied to the first sliding portion 112 and the second sliding portion 114 in the directions deflected with respect to the sliding directions.

Referring to FIG. 7, when the stopper 66 is displaced from the regulating state to the regulating release state, the coil spring 88 that is disposed between the first engaging portion 70 and the first engaging slider 78 is compressed to generate the spring force F1. In addition, the coil spring 92 that is disposed between the second engaging portion 72 and the second engaging slider 80 is also compressed to generate the spring force F2.

The biasing force of the coil spring 88, that is, the spring force F1 biases the first engaging slider 78 in Y axis direction. At this time, the rotation moment N1 (=F1×L1) acts on the first engaging slider 78. In addition, the biasing force of the coil spring 92, that is, the spring force F2 biases the second engaging slider 80 in the Y axis direction. At this time, the rotation moment N2 (=F2×L2) acts on the second engaging slider 80.

Therefore, if the spring force F2 of the coil spring 92 that biases the second engaging slider 80 is set to be the same size force as the spring force F1 of the coil spring 88 that biases the first engaging slider 78 or is set to be a stronger force, the rotation moment N2 which acts on the second engaging slider 80 is greater than the rotation moment N1 which acts on the first engaging slider 78. Thereby, when the stopper mechanism 18 is viewed from the direction Z toward the direction −Z, the stopper mechanism 18 is displaced clockwise around the axis of the cam slider 74, and thus forces are applied to the first sliding portion 112 and the second sliding portion 114 in directions deflected with respect to the sliding directions.

For this reason, in the present embodiment, the spring force F1 of the coil spring 88 that is the first biasing unit and the spring force F2 of the coil spring 92 that is the second biasing unit which biases the second engaging portion 72 are set to be decreased in proportion to the distance from the stopper 66 (as the distances become longer), in comparing the distance L1 with the distance L2. More specifically, the rotation moment N1 (=F1×L1) which acts on the first engaging portion 70 and the rotation moment N2 (=F2×L2) which acts on the second engaging portion 72 are set to be substantially the same. Such a relationship allows that the rotation moments N1 and N2 which act on the first engaging slider 78 and the second engaging slider 80 are balanced with each other, and thereby the forces are unlikely to be applied to the first sliding portion 112 and the second sliding portion 114 in the directions deflected with respect to the directions.

Here, the displacement of the stopper mechanism 18 from the regulating state to the regulating release state will be described with reference to FIGS. 6 and 7. In FIG. 6, the stopper mechanism 18 is in the regulating state. The leading edges of the engaging protrusion portions 120 from the first engaging portion 70 and the second engaging portion 72 are placed at an engaging release position Y1 in the Y axis direction, respectively.

In FIG. 7, if the lower side tray 50 is inserted from the front side of the opposing portion 12*a*, that is, in the −Y axis direction, the leading edge 50*a* of the lower side tray 50 comes into contact with the leading edges of the engaging protrusion portions 120 of the first engaging portion 70 and the second engaging portion 72. If the lower side tray 50 is pushed toward the opposing portion 12*a*, the first engaging portion 70 and the second engaging portion 72 are pushed in the Y axis direction against the biasing force of the coil springs 86 and 90. Thereby, the leading edges of the engaging protrusion portions 120 of the first engaging portion 70 and second engaging portion 72 are displaced to an engaging position Y2. At this time, by the operation of the braking mechanism 115, the cam slider 74 does not move immediately, the coil spring 88 that is disposed between the first engaging portion 70 and the first engaging slider 78 and the coil spring 92 that is disposed between the second engaging portion 72 and the second engaging slider 80 remain in a compressed state for the time being.

The compressed coil springs 88 and 92 generate the spring force F1 of the coil spring 88 and the spring force F2 of the coil spring 92, along the Y axis direction. Accordingly, the generated spring forces F1 and F2 cause the cam slider 74 to move (slide) together with the first engaging slider 78 and the second engaging slider 80 in the Y axis direction. The braking force of the braking mechanism 115 acts on the movement, and thereby the cam slider 74 slowly moves in the Y axis direction at a speed corresponding to the difference between the spring forces F1 and F2 and the braking force. Therefore, in the stopper mechanism 18, the stopper 66 that is operated in link with the cam slider 74 using the cam mechanism is slowly rotated to move from the regulating position to the regulating release position due to the action of the braking force rendered by the braking mechanism 115. Therefore, the stopper 66 reliably regulates the movement of the sheet P1 in the Y axis direction and thereafter, is displaced to the regulating release state.

Next, the displacement of the stopper 66 from the regulating state to the regulating release state will be described with reference to FIGS. 8A and 8B. In FIG. 8A, the stopper 66 is in the regulating state. In FIG. 8A, the cam slider 74, and the stopper 66 that is engaged with the cam slider 74 via the engaging space 116 and the engaging pin 104 are biased by the coil springs 86 and 90, toward a bottom surface engaging portion 96 via the first engaging portion 70, the second engaging portion 72, the first connecting member 82 and the second connecting member 84, that is, in the −Y axis direction. At this time, the stopper 66 is in a state in which the regulating portion 98 is upstanding with respect to the bottom surface 76 of the opposing portion 12*a* and its regulating surface 100 opposes the leading edge of the sheet P1 in the lower side tray 50. Therefore, the regulating surface 100 comes into contact with the leading edge of the sheet P1 and thus it is possible to regulate the movement in the Y axis direction.

As illustrated in FIG. 8B, when the engaging protrusion portion 120 of the second engaging portion 72 (first engaging portion 70) comes into contact with the leading edge 50*a* of the lower side tray 50 and is pushed by the lower side tray 50 in the Y axis direction and thus is displaced to the engaging position Y2, the cam slider 74, as described above, is slowly displaced in the Y axis direction, being delayed by the movement of the first engaging portion 70 and the second engaging portion 72. At this time, the stopper 66 is rotated centering the stopper rotating axis 94 and is operated so that the engaging pin 104 moves into the engaging space 116 and then the regulating surface 100 faces a Y axis direction side. Thereby, the regulating surface 100 releases the regulation of the leading edge of the sheet P1 as illustrated in FIG. 8B.

In addition, in FIG. 8B, the regulating surface 100 that is in the regulating release state is displaced in the Y axis direction side further than the first separating inclined surface 62 and the second separating inclined surface 64 of the first separating unit 22 in order not to disturb the feeding of the sheet P1. In addition, the stopper 66, as illustrated in FIGS. 8A and 8B, is lower than the upper side tray 60 in the height of the Z axis direction. Therefore, the stopper 66 does not disturb the feeding of the sheet P2 which is accommodated in the upper side tray 60.

In addition, as illustrated in FIGS. 8A and 8B, when the leading edge 50*a* of the lower side tray 50 which is in contact with the engaging protrusion portion 120 of the second engaging portion 72 (first engaging portion 70) is displaced from the engaging position Y2 to the engaging release position Y1, the coil springs 86 and 90 bias the first engaging portion 70 and the second engaging portion 72 in the −Y axis direction using their biasing forces. Thereby, the leading edges of the engaging protrusion portions 120 of the first engaging portion 70 and the second engaging portion 72 are displaced from the engaging position Y2 to the engaging release position Y1.

Therefore, the first engaging portion 70 and the second engaging portion 72, and the first engaging slider 78 and the second engaging slider 80 that are respectively connected via the coil springs 88 and 92 are displaced in the −Y axis direction. Thereby, the stopper 66 is biased by the coil springs 88 and 92 in the −Y axis direction via the first engaging portion 70, the second engaging portion 72, the first connecting member 82, the second connecting member 84 and the cam slider 74, and thus is displaced from the regulating release state to the regulating state. That is, the coil springs 86 and 90 causes the stopper 66 to be displaced from the regulating release state to the regulating state.

Modified Example of First Embodiment

In addition, the first embodiment described above may be further modified as below.

(1) In the above embodiment, the lower side tray 50 and the upper side tray 60 are separately configured. However, the lower side tray 50 and the upper side tray 60 may be integrated with each other and both trays may be integrally configured to be attachable to and detachable from the device main body. In this case, the upper side tray 60 is provided so as to be slidable with respect to the lower side tray 50.

(2) In addition, in the above embodiment, the sheet feeding tray is configured in two stages, but it may be configured in only a single stage.

(3) The distance L1 between the stopper 66 and the first engaging portion 70 may be set to be longer than the distance L2 between the stopper 66 and the second engaging portion 72, and may be set to be the same. In this case, the spring forces (biasing forces) F1 and F2 are set so that the rotation moments N1 and N2 are the same, and the spring forces (biasing forces) F3 and F4 are set so that the rotation moments N3 and N4 are the same. In addition, it is desirable that the rotation moments N1 and N2 or the rotation moments N3 and N4 respectively be the same. However, if the forces in the deflected direction are reduced, they may not be the same.

(4) The engaging protrusion portion 120 of the first engaging portion 70 and the second engaging portion 72 may be configured to be engaged with the upper side tray 60, instead of being engaged with the lower side tray 50.

(5) The first biasing unit, the second biasing unit, the third biasing unit and the fourth biasing unit may employ an air pressure and hydraulic pressure, instead of the coil springs 86, 88, 90 and 92.

(6) The respective ends of the third biasing unit and the fourth biasing unit may be fixed to or supported by the first engaging slider 78 and the second engaging slider 80, instead of the first engaging portion 70 and the second engaging portion 72.

(7) The cam slider 74, the first engaging slider 78, the second engaging slider 80, the first connecting member 82 and the second connecting member 84 may be integrally molded.

In addition, in the present embodiment, the feeding device 12 according to the invention is adopted to the ink jet printer as an example of the recording apparatus, but it may be adopted to the other general liquid ejecting apparatuses.

Here, the liquid ejecting apparatus is not limited to a recording apparatus such as a printer in which an ink jet type recording head is used and an ink is ejected from the recording head so that the recording is performed on the recording medium, a copy machine and a facsimile, and may include an apparatus which ejects a liquid corresponding to the use thereof, instead of the ink, is ejected from the liquid ejecting head equivalent to the ink jet type recording head onto the ejecting medium equivalent to the recording medium, and adheres the ejected liquid to the recording medium.

As the liquid ejecting head, in addition to the recording head, a color material ejecting head which is used for manufacturing a color filter of a liquid crystal display and the like, an electrode material (conductive paste) ejecting head which is used for forming an electrode of an organic EL display, a field emission display (FED) and the like, a bio-organic material ejecting head which is used for manufacturing a biochip, and a sample ejecting head as a precision pipette, and the like are exemplified.

In addition, it is to be understood that the invention is not limited to the above embodiments, but within the scope of the invention described in claims, various modifications are possible, which are also included within the scope of the present invention.

The entire disclosure of Japanese Patent Application No. 2012-069212, filed Mar. 26, 2012, is expressly incorporated by reference herein.

What is claimed is:

1. A recording medium feeding device comprising:

a feeding unit that feeds a recording medium;

a tray that accommodates a recording medium, which is attachable to and detachable from a device main body including the feeding unit;

a stopper that is able to switch between a regulating state in which the stopper comes into contact with a leading edge of the recording medium which is accommodated in the tray to regulate a movement of the recording medium, and a regulating release state in which the regulating state is released to enable the recording medium to be fed to a feeding path; and a switching unit that is engaged with the tray to switch the stopper from the regulating state to the regulating release state when the tray is inserted into the device main body, wherein the switching unit includes:

engaging portions that are engaged with the tray, a first slider that is engaged with the stopper and is displaceable in an advancing and retreating direction with respect to the leading edge of the recording medium, a second slider that is displaceable together with the engaging portion in the advancing and retreating direction, and a connecting member that connects the first slider and the second slider together, and wherein the engaging portions are disposed, being separated from the stopper, at both sides of the stopper in a width direction of the recording medium.

2. The recording medium feeding device according to claim 1, wherein the switching unit further includes:

a first biasing unit that biases the stopper in a switching direction of the stopper from the regulating state to the regulating release state in one side of the engaging portions between the engaging portions which are disposed at both sides of the stopper, a second biasing unit that biases the stopper in a switching direction of the stopper from the regulating state to the regulating release state in the other side of the engaging portions between the engaging portions which are disposed at both sides of the stopper, a third biasing unit that biases the stopper in a switching direction of the stopper from the regulating release state to the regulating state in one side of the engaging portions, and a fourth biasing unit that biases the stopper in a switching direction of the stopper from the regulating release state to the regulating state in the other side of the engaging portions.

3. The recording medium feeding device according to claim 2, wherein an individual biasing force of the first biasing unit and the second biasing unit is set to be decreased as a distance becomes longer, depending on the distance between a position at which the individual biasing unit biases the engaging portion and the stopper.

4. The recording medium feeding device according to claim 3, wherein an individual biasing force of the third biasing unit and the fourth biasing unit is set to be decreased as the distance becomes longer, depending on the distance between the position at which the individual biasing unit biases the engaging portion and the stopper.

5. The recording medium feeding device according to claim 1, further comprising:

a braking mechanism that applies a braking force to the stopper when switching from the regulating state of the stopper to the regulating release state.

6. The recording medium feeding device according to claim 1, wherein the connecting member is molded by sheet metal working.

7. A recording apparatus comprising:

a recording unit that performs recording on the recording medium; and the recording medium feeding device according to claim 1.

8. A recording medium feeding device comprising:

a feeding unit that feeds a recording medium;

a lower side tray that accommodates a recording medium, which is attachable to and detachable from a device main body including the feeding unit;

an upper side tray that accommodates a recording medium, which is attachable to and detachable from the device main body and is located above a mounting position of the lower side tray when being mounted in the device main body;

a stopper that is able to switch between a regulating state in which the stopper comes into contact with a leading edge of the recording medium which is accommodated in the lower side tray to regulate a movement of the recording medium, and a regulating release state in which the regulating state is released to enable the recording medium to be fed to a sheet feeding path; and a switching unit that is engaged with the lower side tray to switch the stopper from the regulating state to the regulating release state when the lower side tray is inserted into the device main body, wherein the switching unit includes:

engaging portions that are engaged with the tray, a first slider that is engaged with the stopper and is displaceable in an advancing and retreating direction with respect to the leading edge of the recording medium, a second slider that is displaceable together with the engaging portion in the advancing and retreating direction, and a connecting member that connects the first slider and the second slider together, and wherein the engaging portions are disposed, being separated from the stopper, at both sides of the stopper in a width direction of the recording medium.

9. The recording medium feeding device according to claim 8, wherein the stopper is formed at a height where the stopper is able to engage with the leading edge of the recording medium which is accommodated in the lower side tray, and at a height where the stopper does not engage with the recording medium which is accommodated in the upper side tray.

10. A recording medium feeding device comprising:

a feeding unit that feeds a recording medium;

a tray that accommodates a recording medium, which is attachable to and detachable from a device main body including the feeding unit;

a stopper that is able to switch between a regulating state in which the stopper comes into contact with a leading edge of the recording medium which is accommodated in the tray to regulate a movement of the recording medium, and a regulating release state in which the regulating state is released to be enable the recording medium to be fed to a feeding path; and a switching unit that is engaged with the tray to switch the stopper from the regulating state to the regulating release state when the tray is inserted into the device main body, wherein the switching unit includes:

engaging portions that are engaged with the tray, a first biasing unit that biases the stopper in a switching direction of the stopper from the regulating state to the regulating release state in one side of the engaging portions between the engaging portions which are disposed at both sides of the stopper, a second biasing unit that biases the stopper in a switching direction of the stopper from the regulating state to the regulating release state in the other side of the engaging portions between the engaging portions which are disposed at both sides of the stopper, a third biasing unit that biases the stopper in a switching direction of the stopper from the regulating release state to the regulating state in one side of the engaging portions, a fourth biasing unit that biases the stopper in a switching direction of the stopper from the regulating release state to the regulating state in the other side of the engaging portions, and wherein the engaging portions are disposed, being separated from the stopper, at both sides of the stopper in a width direction of the recording medium.

* * * * *